US006681691B2

(12) United States Patent
Foster et al.

(10) Patent No.: US 6,681,691 B2
(45) Date of Patent: Jan. 27, 2004

(54) SCREEN PRINTING STENCIL PRODUCTION

(75) Inventors: David Joseph Foster, Swindon (GB); Anna Jane Harris, Wantage (GB)

(73) Assignee: Autotype International Limited (GB)

( * ) Notice: Subject to any disclaimer, the term of this patent is extended or adjusted under 35 U.S.C. 154(b) by 202 days.

(21) Appl. No.: 09/900,127

(22) Filed: Jul. 6, 2001

(65) Prior Publication Data

US 2002/0011160 A1 Jan. 31, 2002

Related U.S. Application Data

(63) Continuation of application No. 09/446,169, filed on Mar. 2, 2000, now abandoned.

(51) Int. Cl.[7] ..... B41C 1/14

(52) U.S. Cl. ..... 101/128.4; 101/128.21; 101/129; 427/143

(58) Field of Search ..... 101/114, 128.21, 101/128.4, 129, 401.1; 347/96, 102, 103; 430/308; 427/143, 272, 273; 503/200

(56) References Cited

U.S. PATENT DOCUMENTS

| | | | |
|---|---|---|---|
| 1,606,217 | A | 11/1926 | Gestetner |
| 3,922,445 | A | 11/1975 | Mizuno et al. |
| 4,014,289 | A | 3/1977 | Zimmer |
| 4,254,194 | A | 3/1981 | Merrill et al. |
| 4,412,232 | A | 10/1983 | Weber et al. |
| 4,435,305 | A | 3/1984 | Tsoukalas et al. |
| 4,436,032 | A | 3/1984 | van Ouwerkerk |
| 4,477,557 | A | 10/1984 | Rauch |
| 4,538,156 | A | 8/1985 | Durkee et al. |
| 4,550,660 | A | 11/1985 | Sato et al. |
| 4,583,458 | A | 4/1986 | Beachum |
| 4,896,597 | A | 1/1990 | Hayata et al. |
| 5,188,664 | A | 2/1993 | Adamic et al. |
| 5,213,032 | A | 5/1993 | van Akkeren et al. |
| 5,270,078 | A | 12/1993 | Walker et al. |

(List continued on next page.)

FOREIGN PATENT DOCUMENTS

| | | |
|---|---|---|
| CA | 2088400 | 1/1994 |
| EP | 0 108 509 | 5/1984 |

(List continued on next page.)

OTHER PUBLICATIONS

Thomas Schweizer, Latest situation and current facts on Electronic Stencil Making, Aug. 1997, pp. 66–68.

(List continued on next page.)

*Primary Examiner*—Ren Yan
(74) *Attorney, Agent, or Firm*—Wall Marjama & Bilinski LLP

(57) ABSTRACT

A method of producing a screen-printing stencil having open areas and blocked areas for respectively passage and blocking of a printing medium. The method includes providing a receptor element having an image-receiving layer capable of receiving a first chemical agent in areas corresponding to the blocked areas of the stencil to be produced. A first chemical agent is applied to the image-receiving layer of the receptor element in the corresponding areas. A second, stencil-forming chemical agent is then applied to a screen printing screen and the image-receiving layer fo the receptor element brought into contact with the stencil-forming agent to allow the first and second chemical agents to react to produce on the screen a stencil-forming layer having areas of lower solubility corresponding to the said blocked areas and areas of higher solubility in areas corresponding to the open stencil areas. Any remaining unreacted part of the receptor element is removed and the second chemical agent washed away in the higher solubility areas thereby producing the screen-printing stencil.

74 Claims, 2 Drawing Sheets

U.S. PATENT DOCUMENTS

Figure 1:
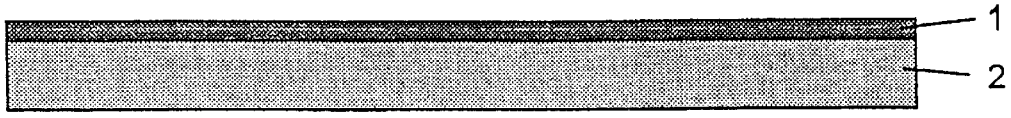

| | | | |
|---|---|---|---|
| 5,292,556 | A | 3/1994 | Ma et al. |
| 5,303,647 | A | 4/1994 | Seo et al. |
| 5,306,376 | A | 4/1994 | James |
| 5,380,769 | A | 1/1995 | Titterington et al. |
| 5,466,653 | A | 11/1995 | Ma et al. |
| 5,553,538 | A | 9/1996 | Freitag |
| 5,654,032 | A | 8/1997 | Gybin et al. |
| 5,749,292 | A | 5/1998 | De Bastiani et al. |
| 5,819,653 | A | 10/1998 | McCue |
| 5,824,362 | A | 10/1998 | Watanabe |
| 5,860,361 | A | 1/1999 | Nanjyo et al. |

FOREIGN PATENT DOCUMENTS

| | | | |
|---|---|---|---|
| EP | 0 108 509 | A | 5/1984 |
| EP | 0 492 351 | A1 | 7/1992 |
| EP | 0 588 399 | A1 | 3/1994 |
| EP | 0 635 362 | A1 | 1/1995 |
| EP | 0 671 268 | A1 | 9/1995 |
| EP | 0 710 552 | A2 | 5/1996 |
| EP | 0 710 552 | A | 8/1996 |
| EP | 0 883 026 | A1 | 12/1998 |
| GB | 180778 | | 6/1922 |
| GB | 1431462 | | 4/1976 |
| WO | 97/43122 | | 11/1997 |

OTHER PUBLICATIONS

Thomas Schweizer, The digital future for large and small size stencil production in Textile, Wallpaper and Graphic screen printing using JetScreen Technology. An important guide to the innovation of Lüscher Ag Maschinenbau, Jan. 1996, pp. 1–7.

Thomas Schweizer, FESPA '96—JetScreen technology—world premier of Luscher AG—showing a new technique in screen making using the computer—to—screen digital process for stencil production, Aug., 1996, pp. 1–3.

Thomas Schweizer, Industrial Screen Printing using the new JetScreen Technology, Aug. 12, 1996, pp. 1–5.

Brochure for ScreenJet—Screen Imaging System for Textile Screenprinting, 2 pages.

The Theory of the Photographic Process, 4th edition, T.H. James, 1977, pp. 77–87.

SCREEN PRINTING STENCIL PRODUCTION

CROSS REFERENCE TO RELATED APPLICATION

This is a continuation application of U.S. Ser. No. 09/446,169, filed Mar. 2, 2000 and now abandoned.

BACKGROUND TO THE INVENTION

1. Field of the Invention

The present invention relates to the production of stencils for screen printing.

2. Related Background Art

The production of screen printing stencils is generally well known to those skilled in the art.

One method, referred to as the "direct method" of producing screen printing stencils involves the coating of a liquid light-sensitive emulsion directly onto a screen mesh. After drying, the entire screen is exposed to actinic light through a film positive held in contact with the coated mesh in a vacuum frame. The black portions of the positive do not allow light to penetrate to the emulsion which remains soft in those areas. In the areas which are exposed to light, the emulsion hardens and becomes insoluble, so that, after washing out with a suitable solvent, the unexposed areas allow ink to pass through onto a substrate surface during a subsequent printing process.

Another method, referred to as the "direct/indirect method" involves contacting a film, consisting of a pre-coated unsensitised emulsion on a base support, with the screen mesh by placing the screen on top of the flat film. A sensitised emulsion is then forced across the mesh from the opposite side, thus laminating the film to the screen and at the same time sensitising its emulsion. After drying, the base support is peeled off and the screen is then processed and used in the same way as in the direct method.

In the "indirect method" a film base is pre-coated with a pre-sensitised emulsion. The film is exposed to actinic light through a positive held in contact with the coated film. After chemical hardening of the exposed emulsion, the unexposed emulsion is washed away. The stencil produced is then mounted on the screen mesh and used for printing as described above for the direct method.

In the "capillary direct method" a pre-coated and pre-sensitised film base is adhered to one surface of the mesh by the capillary action of water applied to the opposite surface of the mesh. After drying, the film is peeled off and the screen then processed and used as described for the direct method.

In addition to the above methods, hand-cut stencils can be used. These are produced by cutting the required stencil design into an emulsion coating on a film base support. The cut areas are removed from the base before the film is applied to the mesh. The emulsion is then softened to cause it to adhere to the mesh. After drying, the base is peeled off. The screen is then ready for printing. This method is suitable only for simple work.

One problem generally associated with all the prior art methods is that many steps are necessary to produce the screen, thus making screen production time-consuming and labour-intensive.

Another problem is that normal lighting cannot be used throughout the screen production process in any of the methods except hand cutting. This is because the stencil materials are light-sensitive. In addition, it is necessary to provide a source of actinic (usually UV) light for exposing the stencil. This usually incurs a penalty of initial cost, space utilisation and ongoing maintenance costs.

Other methods of preparing printing screens are available. CA-A-2088400 (Gerber Scientific Products, Inc.) describes a method and apparatus in which a blocking composition is ejected directly onto the screen mesh surface in a pre-programmed manner in accordance with data representative of the desired image. The blocking composition directly occludes areas of the screen mesh to define the desired stencil pattern.

EP-A-0492351 (Gerber Scientific Products, Inc.) describes a method where an unexposed light-sensitive emulsion layer is applied to a screen mesh surface and a graphic is directly ink-jet printed on the emulsion layer by means of a printing mechanism to provide a mask through which the emulsion is exposed before the screen is further processed.

Both the above methods require the use of very specialised equipment (because of the need to handle large complete screens) which incurs a certain cost as well as imposing restrictions arising from the limitations of the equipment, in particular in terms of the size of screen and its resolution.

Ink-jet printers operate by ejecting ink onto a receiving substrate in controlled patterns of closely spaced ink droplets. By selectively regulating the pattern of ink droplets, ink-jet printers can be used to produce a wide variety of printed materials, including text, graphics and images on a wide range of substrates. In many ink-jet printing systems, ink is printed directly onto the surface of the final receiving substrate. An ink-jet printing system where an image is printed on an intermediate image transfer surface and subsequently transferred to the final receiving substrate is disclosed in U.S. Pat. No. 4,538,156 (AT&T Teletype Corp.). Furthermore, U.S. Pat. No. 5,380,769 (Tektronix Inc.) describes reactive ink compositions containing at least two reactive components, a base ink component and a curing component, that are applied to a receiving substrate separately. The base ink component is preferably applied to the receiving substrate using ink-jet printing techniques and, upon exposure of the base ink component to the curing component, a durable, crosslinked ink is produced.

SUMMARY OF THE INVENTION

According to the present invention there is provided a method of producing a screen-printing stencil having open areas and blocked areas for respectively passage and blocking of a printing medium, the method comprising:

- providing a receptor element comprising an optional support base and an image-receiving layer capable of receiving a first chemical agent in areas corresponding to the blocked areas of the stencil to be produced;
- applying the first chemical agent to the image-receiving layer of the receptor element in the said corresponding areas;
- applying a second, stencil-forming chemical agent to a screen printing screen;
- bringing the image-receiving layer of the receptor element into contact with the stencil-forming agent, to allow the first and second chemical agents to react to produce on the screen a stencil-forming layer having areas of lower solubility corresponding to the said blocked areas and areas of higher solubility in areas corresponding to the open stencil areas;
- removing any remaining unreacted part of the receptor element; and washing away the second chemical agent in the higher solubility areas, thereby to produce the screen-printing stencil.

In the method of the invention, the stencil is formed by chemical means without the need to use either special lighting conditions or actinic radiation.

Also, it is possible to carry out the method at reduced expenditure of time and time labour, compared with the known processes.

The steps of removing any remaining unreacted part of the receptor element and of washing away the second chemical agent in the higher solubility areas can be carried out in either order or simultaneously. Thus, when the unreacted part of the receptor element comprises a coherent film (for example the optional support base referred to or the image-receiving layer itself), the film can be removed, for example by being peeled away, before the washing away step. Alternatively, the film can be removed in the course of the washing away step, either by the washing action or otherwise, or even be removed after the washing away step. In some cases however the remaining unreacted part of the receptor element may be a material which is removed by the washing action, for example when the optional support base is absent and the image-receiving layer is insufficiently coherent to be removed as an intact layer, for example by peeling away.

Advantageously, the first chemical agent is applied dropwise to the image-receiving layer.

Conveniently, the dropwise application is by use of an ink-jet device, for example an ink-jet printer or plotter. The device may have one or more ejection heads.

If desired, the first chemical agent may be produced in situ by reaction between two or more precursor materials, separately applied to the image-receiving layer, prior to contact with the stencil forming agent, at least one of which is applied in the said areas corresponding to the blocked areas of the stencil to be produced. This may conveniently be achieved by use of a plurality of drop-ejection heads.

When dropwise application is employed, the application is preferably controlled according to data encoding the desired pattern of blocked and open areas of the stencil to be produced. This control is conveniently by a computer, for example a personal computer. Thus, data representative of the desired output pattern can be input to a controller as pre-recorded digital signals which are used by the ejection head to deposit or not deposit the liquid containing the chemical agent as it scans the surface of the receptor element. The invention is not however restricted to dropwise application of the first chemical agent: other methods of application will achieve the same essential end, for example, the first chemical agent could be applied with a hand-held marker pen.

The method according to the invention can be carried out using a material of the image-receiving layer which is essentially unreactive with the first chemical agent. In such a process, the image-receiving layer acts essentially as an inert carrier for the first chemical agent. The stencil-forming layer of the eventual stencil is thus derived essentially from the second chemical agent applied to the screen.

Preferably however the material of the image-receiving layer is selected to react with the first chemical agent to produce lower solubility areas corresponding to the said blocked areas and excess of the first chemical agent (or a component of it, not necessarily the same as the component that reacts with the image-receiving layer) remains in said areas to react with the second chemical agent upon contact between the image-receiving layer and the stencil-forming agent, whereby the respective lower solubility areas of the image-receiving layer and of the stencil-forming layer combine with one another and, after the higher solubility areas are washed away, remain to form the blocked areas of the screen-printing stencil.

In such a method, the stencil-forming layer of the eventual stencil is derived in part from the second chemical agent and in part from the image-receiving layer of the receptor element. In this case, the thickness of the stencil-forming layer can be such as to give the eventual screen a "profile", that is a significant thickness to the closed areas of the stencil beyond the thickness of the screen itself. This is of benefit in terms of the quality of printed images which are obtainable by use of the screen as it allows a significant ink deposit to be applied during printing and permits more precise control of the amount of ink deposited. It also produces a flat printing surface which gives better resolution and improved definition by limiting ink spread during printing.

In one variant of the method of the invention, the second chemical agent is applied to the screen printing screen from one side thereof after the receptor element has been applied to the other side thereof with its image-receiving layer in contact with the screen, whereby the image-receiving layer is brought into contact with the second chemical agent.

In another variant, the second chemical agent is applied to the screen printing screen and the receptor element is subsequently brought into contact with the screen to bring the image-receiving layer thereof into contact with the second chemical agent.

DETAILED DESCRIPTION OF THE INVENTION

The invention will be described further by way of example with reference to the drawings of this specification, in which FIGS. 1 to 5 show schematically the successive steps in the production of a printing screen in accordance with one method according to the invention, and FIGS. 6 to 10 show schematically the successive steps in the production of a screen in accordance with a second method according to the invention.

Figure 3:
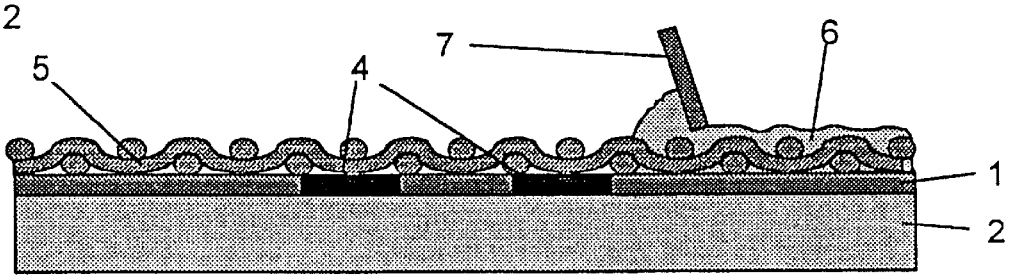
Figure 4:
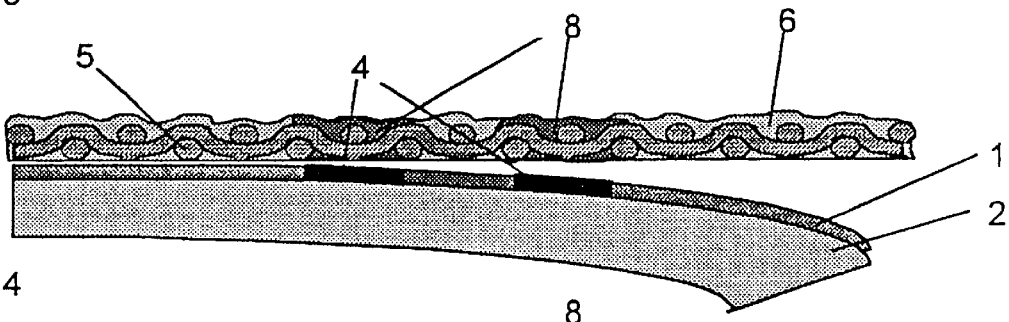
Figure 5:
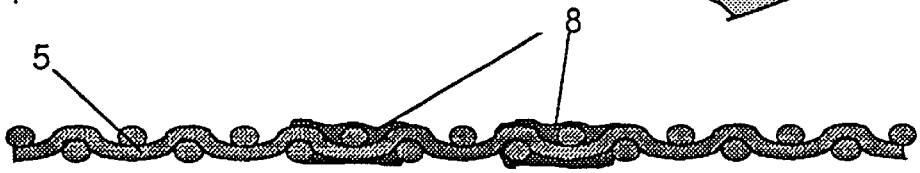

Referring to FIGS. 1 to 5, these show the formation of a screen printing stencil shown in FIG. 5, starting with a receptor element shown in FIG. 1.

FIG. 1 shows the receptor element which consists of an image-receiving layer 1 coated on a flexible film support base 2. In this example, the image-receiving layer is about 10 $\mu$m in thickness and the support base about 75 $\mu$m.

Figure 2:
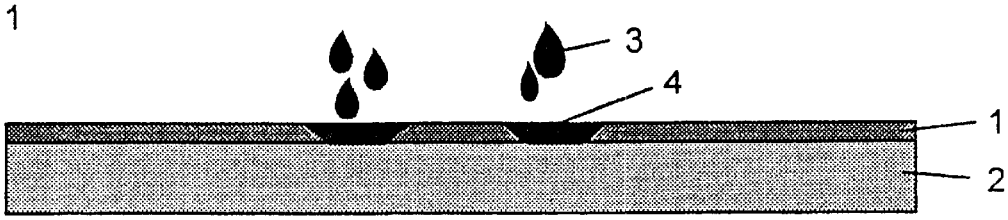

FIG. 2 shows a first chemical agent 3 being applied to the image-receiving layer 1 in droplets 3 which are ejected from an ejection head (not shown) of, for example, an ink-jet printer controlled by a computer. The first-chemical agent 3 is absorbed into the image-receiving layer 1 to form areas 4 which correspond to the blocked areas of the stencil to be formed.

FIG. 3 of the drawings shows a screen mesh 5 to one surface of which the receptor element of FIG. 2 has been applied and to the other of which a stencil-forming agent 6 is being applied using a suitable spreader 7. In FIG. 3 the image-receiving layer 1 of the receptor element is brought into contact with the stencil-forming agent 6 when the latter is forced through the mesh 5 by the spreader 7.

This contact could alternatively have been achieved by first coating the mesh 5 with the stencil-forming agent 6 and then applying the receptor element to the mesh 5.

FIG. 4 of the drawings shows the receptor element 1 consisting of the support base 2 and the image-receiving layer 1, including the areas 4 where the first chemical agent was absorbed, being peeled away from the image-receiving layer 1. The areas of the stencil-forming agent 6 corresponding to the areas 4 of the image-receiving layer have reacted with the first chemical agent to produce areas 8 of insoluble material.

FIG. 5 shows the final screen after the support base 2 has been peeled away and the screen washed out so that the reduced-solubility areas of the stencil-forming agent and the areas 4 of the image-receiving layer to which the first chemical agent was applied remains and the higher solubility areas have been washed away.

FIGS. 6 to 10 of the drawings correspond to FIGS. 1 to 5 but show the production of a stencil using a receptor element having an image-receiving layer which reacts with the first chemical agent to produce areas which become incorporated into the stencil-forming layer of the final stencil.

Reference numerals increased by "10" are used in FIGS. 6 to 10 to identify integers corresponding to integers of FIGS. 1 to 5.

Figure 6:
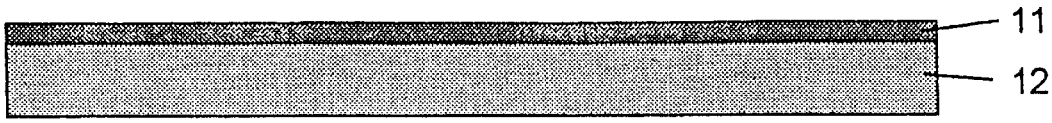
Figure 7:
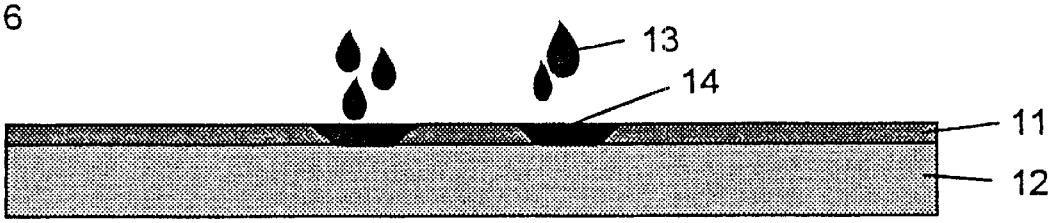
Figure 8:
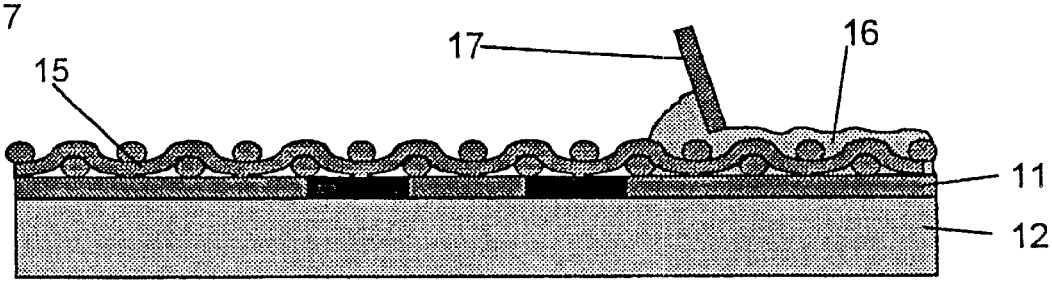

FIGS. 6 to 8 show operations corresponding to the operations of FIGS. 1 to 3. In FIG. 7 the first chemical agent 13 reacts with the image-receiving layer 11 in the areas 14 but excess of the first chemical agent remains in those areas, to react with the stencil-forming agent 16 as it is applied as shown in FIG. 8.

Figure 9:
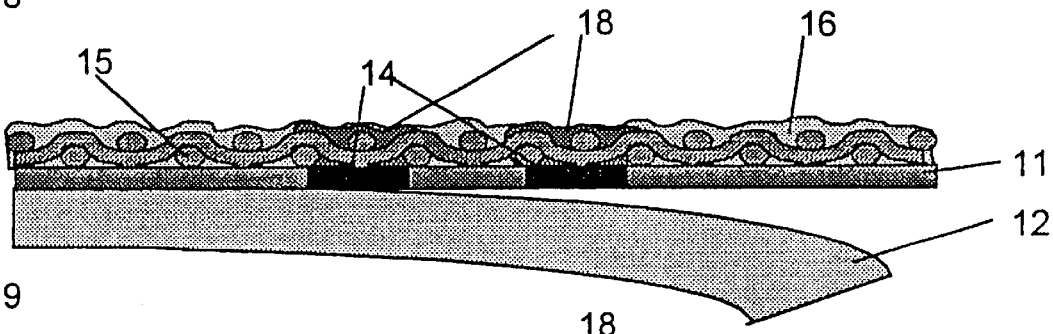
Figure 10:
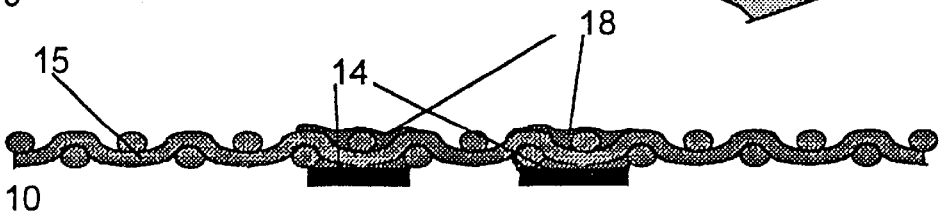

FIG. 9 therefore shows that, as the support base 12 is peeled away, the areas 14 of the image-receiving layer have become combined with the areas 18 of the stencil-forming layer and, as shown in FIG. 10 after washing out, remain in the final stencil to provide the desirable "profile" to which reference has already been made. The remaining, unreacted areas of the image-receiving layer are washed away with the high solubility areas 16 of the stencil-forming layer in the subsequent washing step.

When the image-receiving layer is substantially inert to the first chemical agent it can comprise an inert polymer such as methyl hydroxy propyl cellulose which is preferably present in the image-receiving layer in an amount of 5 to 100 wt. % with the balance comprising, for example, suitable other polymers and/or suitable fillers, binders and plasticisers.

Numerous other inert polymers could alternatively be utilised for use in the present invention. Suitable polymers include those that have no chemical reaction or only an insignificantly slow chemical reaction with the first chemical agent to be used. Examples of such polymers are:

carboxymethyl cellulose;
polyvinylpyrrolidone; and
polyacrylic acids.

In addition, papers, including ordinary papers, can be used as the inert image-receiving layer, and, thereby, require no supporting base.

The key criterium in selecting a suitable combination of image-receiving layer and first chemical agent is that the first chemical agent should form a good image on the layer; for example, a drop of the first chemical agent should neither be so repelled by the layer as to produce a defective image nor it should not spread so far as to reduce the resolution of the image. Moreover, it should not spread so anisotropically (because of irregularities in the layer) as to deform the image.

When the image-receiving layer reacts with the first chemical agent and thus forms a part of the final screen stencil, the image-receiving layer may comprise a polymer which reacts with the first chemical agent. When the stencil-forming agent is applied and reacts with the first chemical agent (or a component of it, not necessarily the same as the component that reacts with the image-receiving layer), the layer of stencil-forming agent and the reacted part of the image-receiving layer become essentially one.

A typical example of such a polymer is polyvinyl alcohol which is preferably present in an amount of 5 to 100 wt. % of the image-receiving layer with the balance comprising, for example, other suitable polymers and/or suitable fillers, binders and plasticisers. The polyvinyl alcohol preferably has a degree of hydrolysis of 20 to 99.9 mole % and, independently thereof, a degree of polymerisation of 100 to 3500.

Numerous other reactive polymers could alternatively be utilised in the present invention. Suitable polymers include those that change their solubility characteristics on treatment with a suitable first chemical agent. Examples of such polymers are:

gelatin and its derivatives;
carboxylated polymers capable of becoming water soluble on addition of alkali, including carboxylated acrylics, ethylene-acrylic acid and styrene-acrylic acid copolymers;
cellulose derivatives that are water soluble, including starch and hydroxypropyl cellulose;
sulphonated polymers;
polyacrylamides;
epoxy resins; and
amino resins, including urea-formaldehyde and melamine-formaldehyde.

In methods of either type according to the invention, the polymers and other components are chosen so that the first chemical agent forms a good image when applied. Layers that are not compatible with any solvent used in the first chemical agent (typically, water) will produce insufficient spread of the liquid and a poor-quality image will result. If the layer has too great an affinity with the first chemical agent, the liquid will spread too far, giving a blurred, low resolution image.

A receptor element can be with or without a support base. Without the support base, the image receiving layer is typically 6 to 250 $\mu$m in thickness. With a support base the coating thickness is typically from 0.1 to 50 $\mu$m.

The support base may comprise a non-reactive polymer, preferably an organic resin support, e.g. polyethylene terephthalate, polyethylene, polycarbonate, polyvinyl chloride or polystyrene. Alternatively a coated paper could be used as the receptor element, the paper and coating constituting the support base and the image-receiving layers, respectively. An uncoated paper can alternatively constitute the image-receiving layer of a receptor element without a support base. Such an image-receiving layer is usually removed as a coherent film prior to washing away of the high solubility areas of the stencil-forming layer. The thickness of the support base film is preferably from 10 to 200 $\mu$m. The organic resin supports can optionally be coated with a subbing layer to give desired adhesion properties with the image-receiving layer. When used, the support base is usually removed as a coherent film in the screen production method prior to the removal of the areas of higher solubility, though it can be removed during this process.

The first chemical agent is applied to the image-receiving layer. The liquid may be applied dropwise, conveniently by an ink-jet system such as (but not confined to) an ink-jet printer or ink-jet plotter. Alternatively, application can be continuous, for example by a hand held delivery device, such as a pen. The liquid applied should exhibit desirable stability, surface tension and viscosity characteristics and may therefore contain surfactants, viscosity modifiers, light stabilisers and/or anti-oxidants. When the active component (s) of the first chemical agent is/are not liquids, the first chemical agent may include a suitable carrier, for example a suitable solvent or dispersant for the active components.

Examples of suitable active components include boron salts e.g. boric acid, Group I and Group II metal borates;

aldehydes, e.g. formaldehyde;

dialdehydes, e.g. glyoxal and glutaraldehyde, optionally activated by treatment with mineral acid;

isocyanates and their derivatives, e.g. toluenediisocyanate;

carbodiimides and their derivatives, e.g. 1,3-dicyclohexylcarbodiimide;

transition metal compounds and complexes, e.g. pentahydroxy(tetradecanoate)dichromium and its derivatives;

aziridine and its derivatives; amines;

multifunctional silane compounds, e.g. silicon tetraacetate; N-methylol compounds, e.g. dimethylolurea and methyloldimethylhydantoin; and active vinyl compounds, e.g. 1,3,5-triacryloyl-hexahydro-s-triazine.

For use in a dropwise application device such as an ink-jet printer or plotter the invention provides a pre-filled cartridge for such a device, the cartridge containing one or more of the above chemical agents optionally in a suitable liquid solvent or carrier.

In the method of the invention the receptor element having had the first chemical agent applied to it may be placed on a solid flat surface and a screen mesh is placed on top such that there is close contact between the mesh and the receptor element. The stencil-forming agent is then typically applied to the screen mesh by a coating trough or squeegee whereby the first chemical agent is brought into contact with the stencil-forming agent, and reacts therewith so reducing its solubility in predetermined areas. Alternatively, a thin layer of the stencil-forming agent can be coated onto the screen mesh, for example by a coating trough or squeegee and the receptor element mounted manually with slight pressure, a technique well-known to those skilled in the screen printing art.

A typical example of a stencil-forming agent comprises an aqueous solution, dispersion or emulsion of polyvinyl alcohol, with a degree of hydrolysis of 20 to 99.9 mole % and a degree of polymerisation of 100 to 3500, as the reactive polymer in proportion of 5 to 100 wt. % and the remainder of the layer contains polymers, fillers, binders and plasticisers as normally found in the art.

Numerous other active polymers could alternatively be utilised as stencil-forming agents in the present invention. Examples of such polymers are:

gelatin and its derivatives; carboxylated polymers capable of becoming water soluble on addition of alkali, including carboxylated acrylics, ethylene-acrylic acid and styrene-acrylic acid copolymers;

cellulose derivatives that are water soluble, including starch and hydroxypropyl cellulose;

sulphonated polymers;

polyacrylamides;

epoxy resins; and amino resins, including urea-formaldehyde and melamine-formaldehyde.

If a support base is used, this can conveniently be removed once the reaction of the first chemical agent with the stencil-forming agent has substantially been completed. The resulting screen stencil can be developed by washing away the portion of higher solubility with a suitable solvent, thereby leaving behind areas of reduced solubility to occlude areas of the mesh (this act of washing could also remove the optional support base and any other coherent film part of the receptor element if not removed earlier).

Optionally, the stencil can be further toughened by a post-treatment, for example using extra chemicals, actinic radiation or heat. The extra chemicals (or precursors thereof) may be resident in the original image-receiving layer or in the stencil forming agent, or may be supplied externally. Examples of chemical toughening agents are ones operating at pH 7 or higher and include dialdehydes particularly glyoxal, and aqueous bases, for example aqueous potassium carbonate. It is presently believed that these toughening agents will only work when a boron salt is used as the first chemical agent.

The screen produced is then ready for use as a printing medium using techniques familiar to those skilled in the art. Where the chemicals used are those cited in the Examples 1 to 8 which follow, the broad physical properties, chemical resistances, washout solvent (water) and reclaim chemicals (typically periodate systems) will in many cases be those used routinely by screen printers. So, although the method of producing the stencil is new, the resulting product will often be familiar and highly acceptable to screen printers.

Surprisingly, we have found that when the active component of the first chemical agent is a boron-containing salt, the stencil can be reclaimed with dilute acid without the use of the industry-standard periodate system. This low cost and environmentally-friendlier reclaim system is a distinct added advantage.

The advantages of the method of the present invention include: a screen stencil can be produced directly from digital information sources; unlike the methods disclosed in CA-A-2088400 and EP-A-0492351 which ink-jet print onto a screen mounted in a frame, it is possible to use any general-purpose ink-jet printer using rolls or sheets of film; it is not necessary to use safe-lights during the stencil making process; there is no requirement for an exposure step utilising an actinic radiation source; and a finished stencil can be produced in a shorter time than by conventional screen printing techniques.

The present invention is illustrated by the following examples without however being limited thereto. In these examples, various commercially-available materials are listed by their trade names; the following letters identifying the following companies:

(a) 3M, UK (b) Autotype International, UK (c) DuPont, UK (d) Nippon Gohsei, Japan Examples 1 to 4 involve the use of non-reactive image-receiving layers; examples 5 to 8 involve the use of reactive image-receiving layers.

EXAMPLE 1

A liquid containing a first chemical agent was prepared according to the formula:

water—87 wt. %;

potassium tetraborate—10 wt. %;

borax—2 wt. %; and "Fluorad FC-93" (a) (1 wt. % aqueous solution)—anionic fluorinated surfactant—1 wt. %.

A receptor element was prepared. Methyl hydroxy propyl cellulose (10 wt. % solution in water) was coated onto a subbed 75 $\mu$m polyethylene terephthalate film from an aqueous solution to form a receptor element comprising a polyethylene terephthalate support base and an image receiving layer of 10 $\mu$m thickness. The sub comprised a 1 wt. % methanol solution of "Elvamide 8063" (c)—coated using a 6 thou. Meyer bar.

The resulting receptor element was passed through a typical commercial ink-jet printer (Hewlett Packard HP550 at 300 dpi) connected to a personal computer and the liquid containing the chemical agent was applied in a preprogrammed manner to form the desired image. The receptor element was then placed on a glass plate, with the coated layer facing uppermost. The receptor element was covered with a screen mesh of mesh count 62 threads per cm. Then a bead of a typical (but unsensitized) polyvinylalcohol/polyvinyl acetate screen emulsion—"2000" (b)—was placed on the upper side of the mesh and drawn over the receptor element by means of a squeegee so that a thin layer of emulsion was forced through the mesh. After 1 minute, the polyethylene terephthalate support base was removed from the mesh. The resulting screen was left to dry and then washed out using cold running water, until the portion of the assembly of higher solubility was washed away to waste.

The stencil was then placed in a standard screen printing machine and prints of an acceptable quality were obtained using standard solvent-based screen printing inks.

EXAMPLE 2

A liquid containing a first chemical agent was prepared according to the formula:

water—50 wt. %; and

"Quilon C" (b)—pentahydroxy(tetradecanoate)dichromium, 50 wt. %. "Quilon C " is itself a 25% solution in acetone/isopropyl alcohol.

Polyvinylpyrrolidone (10 wt. % solution in water) was coated onto a 75 μm polyethylene terephthalate film from an aqueous solution to form a receptor element comprising a polyethylene terephthalate support base and an image receiving layer of 10 μm thickness.

The resulting receptor element was passed through a typical commercial ink-jet printer (Hewlett Packard HP550 at 300 dpi) connected to a personal computer and the liquid containing the chemical agent was applied in a preprogrammed manner to form the desired image. The receptor element was then placed on a glass plate, with the coated layer facing uppermost. The receptor element was covered with a screen mesh of mesh count 62 threads per cm. Then a bead of a typical (but unsensitized) polyvinylalcohol/polyvinyl acetate screen emulsion—"2000" (c)—was placed on the upper side of the mesh and drawn over the receptor element by means of a squeegee so that a thin layer of emulsion was forced through the mesh. The polyethylene terephthalate support base was removed from the mesh. The resulting screen was left to dry thoroughly using a hot air fan and then washed out using cold running water, until the portion of the assembly of higher solubility was washed away to waste.

The stencil was then placed in a standard screen printing machine and prints of an acceptable quality were obtained using standard solvent-based screen printing inks.

EXAMPLE 3

The procedure of Example 1 above was repeated exactly to produce a screen stencil.

This stencil was then treated with a 10 wt. % aqueous solution of potassium carbonate, which was applied by brush so as to cover the entire stencil area, then finally allowed to dry. This produced a toughened stencil, which was placed in a standard screen printing machine and prints of an acceptable quality were obtained using standard solvent-based screen printing inks.

EXAMPLE 4

The procedure of Example 1 above was repeated exactly to produce a screen stencil.

This stencil was then treated with a 2 wt. % solution of 35 wt. % hydrochloric acid, which was applied by brush so as to cover the entire stencil area. This treatment disrupted the screen stencil and allowed the resulting residue to be washed away to waste using a cold water spray, giving a reclaimed screen with no observable stain present.

EXAMPLE 5

A liquid containing a chemical agent was prepared according to the formula:

water—87 wt. %;

potassium tetraborate—10 wt. %;

borax—2 wt. %; and

"Fluorad FC-93" (a) (1 wt. % aqueous solution)—anionic fluorinated surfactant—1 wt. %.

Polyvinyl alcohol—"Gohsenol GH-20" (d) (10 wt. % solution in water) of hydrolysis 88% and degree of polymerisation 2000, was coated onto a unsubbed 75 μm polyethylene terephthalate film from an aqueous solution to form a receptor element comprising a polyethylene terephthalate support base and an image receiving layer of 10 microns thickness.

The resulting receptor element was passed through a typical commercial ink-jet printer (Hewlett Packard HP550 at 300 dpi) connected to a personal computer and the liquid containing the chemical agent was applied in a preprogrammed manner to form the desired image.

The receptor element was dried, then placed on a glass plate, with the coated layer facing uppermost. The receptor element was covered with a screen mesh of mesh count 62 threads per cm. Then a bead of a typical (but unsensitized) polyvinylalcohol/polyvinyl acetate screen emulsion—"2000" (c)—was placed on the mesh and drawn over the receptor element by means of a squeegee so that a thin layer of emulsion was forced through the mesh. The screen was dried by hot air fan until the polyethylene terephthalate support base could be peeled cleanly from the mesh. The screen was left to dry and then washed out using cold running water, until the portion of the assembly of higher solubility was washed away to waste.

The stencil was then placed in a standard screen printing machine and prints of an acceptable quality were obtained using standard solvent-based screen printing inks.

EXAMPLE 6

A 50:50 wt. % blend of polyvinyl alcohol—"Gohsenol GH20" (d) and polyvinyl acetate was coated onto an unsubbed 75 μm microns polyethylene terephthalate film from an aqueous solution to form a receptor element comprising a polyethylene terephthalate support base and an image-receiving layer of 10 μm thickness.

The resulting receptor element was passed through a typical commercial ink-jet printer (Hewlett Packard HP550 at 300 dpi) connected to a personal computer and liquid containing a chemical agent was applied according to the formula:

water–50 wt. %; and

"Quilon C" (b)—pentahydroxy(tetradecanoate)dichromium, 50 wt. %. "Quilon C" is itself a 25% solution in acetone/isopropyl alcohol.

The receptor element was then treated in exactly the same manner as in Example 5 above.

The stencil was then placed in a standard screen printing machine and prints of an acceptable quality were obtained using standard solvent-based screen printing inks.

EXAMPLE 7

The procedure of Example 5 above was repeated exactly to produce a screen stencil.

This stencil was then treated with a 10 wt. % solution of potassium carbonate which was applied by brush so as to cover the entire stencil area, then finally allowed to dry. This produced a toughened stencil, which was placed in a standard screen printing machine and prints of an acceptable quality were obtained using standard solvent-based screen printing inks.

EXAMPLE 8

The procedure of Example 5 above was repeated exactly to produce a screen stencil.

This stencil was then treated with a 5 wt. % solution of glacial acetic acid, which was applied by brush so as to cover the entire stencil area. This treatment disrupted the screen stencil and allowed the resulting residue to be washed away to waste using a cold water spray, giving a reclaimed screen with no observable stain present.

What is claimed is:

1. A method of producing a screen-printing stencil having open areas and blocked areas for respectively passage and blocking of a printing medium, the method comprising:

providing a receptor element comprising an image-receiving layer capable of receiving a first chemical agent in areas corresponding to the blocked areas of the stencil to be produced;

applying the first chemical agent to the image-receiving layer of the receptor element in the said corresponding areas;

applying a second, stencil-forming chemical agent to a screen printing screen, bringing the image-receiving layer of the receptor element into contact with the stencil-forming agent, to allow the first and second chemical agents to react to produce on the screen a stencil-forming layer having areas of lower solubility corresponding to the said blocked areas and areas of higher solubility in areas corresponding to the open stencil areas;

removing any remaining unreacted part of the receptor element; and washing away the second chemical agent in the higher solubility areas, thereby to produce the screen-printing stencil.

2. A method according to claim 1, wherein the first chemical agent is produced in situ by reaction between two or more precursor materials, separately applied to the image-receiving layer, prior to contact with the stencil forming agent, at least one of which is applied in the said areas corresponding to the blocked areas of the stencil to be produced.

3. A method according to claim 2, wherein the first chemical agent precursor applied in the areas corresponding to the blocked areas of the stencil to be produced comprises a reactive dialdehyde and a further first chemical agent precursor is a dilute acid.

4. A method according to claim 3, wherein the reactive dialdehyde is water-soluble.

5. A method according to claim 4, wherein the dialdehyde is glyoxal.

6. A method according to claim 4, wherein the dialdehyde is glutaraldehyde.

7. A method according to claim 3, wherein the dilute acid is an acid which lowers the pH to 4 or less when mixed with the dialdehyde.

8. A method according to claim 7, wherein the acid is hydrochloric acid.

9. A method according to claim 7, wherein the acid is citric acid.

10. A method according to claim 1, wherein the image-receiving layer of the receptor element reacts with the first chemical agent to produce lower solubility areas corresponding to the said blocked areas and excess of the first chemical agent remains in said areas to react with the second chemical agent upon contact between the image-receiving layer and the stencil-forming agent, whereby the respective lower solubility areas of the image-receiving layer and of the stencil-forming layer combine with one another and, after the higher solubility areas are washed away, remain to form the blocked areas of the screen-printing stencil.

11. A method according to claim 10, wherein the image-receiving layer comprises one or more of the polymers selected from the group consisting of polyvinylalcohol and its derivatives; gelatin and its derivatives; carboxylated polymers capable of becoming water soluble on addition of alkali; water-soluble cellulose derivatives; sulphonated polymers; polyacrylamides; epoxy resins; and amino resins.

12. A method according to claim 11, wherein the image-receiving layer comprises, as a said carboxylated polymer, a carboxylated acrylic polymer.

13. A method according to claim 11, wherein the image-receiving layer comprises, as a said carboxylated polymer, an ethylene-acrylic acid copolymer.

14. A method according to claim 11, wherein the image-receiving layer comprises, as a said carboxylated polymer, a styrene-acrylic acid copolymer.

15. A method according to claim 11, wherein the image-receiving layer comprises, as a water-soluble cellulose derivative, starch.

16. A method according to claim 11, wherein the image-receiving layer comprises, as a water-soluble cellulose derivative, hydroxypropyl cellulose.

17. A method according to claim 11, wherein the image-receiving layer comprises, as an amino resin, a urea-formaldehyde resin.

18. A method according to claim 17, wherein the image-receiving layer has a thickness of from 0.1 to 50 $\mu$m.

19. A method according to claim 11, wherein the image-receiving layer comprises, as an amino resin, a melamine-formaldehyde resin.

20. A method according to claim 11, wherein the image-receiving layer comprises polyvinyl alcohol with a degree of hydrolysis of from 20 to 99.9 mole %.

21. A method according to claim 11, wherein the image-receiving layer comprises polyvinyl alcohol with a degree of polymerisation of from 100 to 3500 mole %.

22. A method according to claim 1, wherein the image-receiving layer comprises at least one polymers selected from the group consisting of methyl hydroxy propyl cellulose, carboxymethyl cellulose, polyvinylpyrrolidone and polyacrylic acids.

23. A method according to claim 22, wherein the polymer (s) is/are present in the image-receiving layer in a total amount of 5 to 100 wt % of the image-receiving layer.

24. A method according to claim 23, wherein the image-receiving layer contains at least one material selected from the group consisting of fillers, binders and plasticisers.

25. A method according to claim 1, wherein the image-receiving layer comprises paper.

26. A method of claim 1 wherein the receptor element includes a support base.

27. A method according to claim 26, wherein the support base is from 10 to 200 μm in thickness.

28. A method according to claim 27, wherein the support base comprises at least one material selected from the group consisting of polyethylene terephthalate, polyethylene, polycarbonate, polyvinyl chloride, polystyrene and coated paper.

29. A method according to claim 1, wherein the image-receiving layer has a thickness of from 6 to 250 μm.

30. A method of claim 1, wherein the second chemical agent comprises one or more of the polymers selected from the group consisting of polyvinylalcohol and its derivatives; gelatin and its derivatives; carboxylated polymers capable of becoming water soluble on addition of alkali; water-soluble cellulose derivatives; sulphonated polymers; polyacrylamides; epoxy resins; and amino resins.

31. A method according to claim 30, wherein the second chemical agent comprises, as a said carboxylated polymer, a carboxylated acrylic polymer.

32. A method according to claim 30, wherein the second chemical agent comprises, as a said carboxylated polymer, an ethylene acrylic acid copolymer.

33. A method according to claim 30, wherein the second chemical agent comprises, as a said carboxylated polymer, a styrene-acrylic acid copolymer.

34. A method according to claim 30, wherein the second chemical agent comprises, as a water-soluble cellulose derivative, starch.

35. A method according to claim 30, wherein the second chemical agent comprises, as a water-soluble cellulose derivative, hydroxypropyl cellulose.

36. A method according to claim 30, wherein the second chemical agent comprises, as an amino resin, a urea-formaldehyde resin.

37. A method according to claim 30, wherein the second chemical agent comprises, as an amino resin, a melamine-formaldehyde resin.

38. A method according to claim 1, wherein the active component(s) of the first chemical agent comprises at least one member of the group consisting of boron salts; boric acid; aldehydes; isocyanates; isocyanate derivatives; carbodiimides; carbodiimide derivatives; transition metal compounds; transition metal complexes; aziridine; aziridine derivatives; amines; multifunctional silane compounds; N-methylol compounds; and active vinyl compounds.

39. A method according to claim 38, wherein the active component(s) of the first chemical agent comprises one or more Group I or Group II metal borates.

40. A method according to claim 38, wherein the active component(s) of the first chemical agent comprises formaldehyde.

41. A method according to claim 38, wherein the active component(s) of the first chemical agent comprises a dialdehyde.

42. A method according to claim 41, wherein the dialdehyde is glyoxal.

43. A method according to claim 41, wherein the dialdehyde is glutaraldehyde.

44. A method according to claim 41, wherein the dialdehyde is activated by treatment with mineral acid.

45. A method according to claim 38, wherein the active component(s) of the first chemical agent comprises toluene-diisocyanate.

46. A method according to claim 38, wherein the active component(s) of the first chemical agent comprises 1,3-dicyclohexylcarbodiimide.

47. A method according to claim 38, wherein the active component(s) of the first chemical agent comprises pentahydroxy (tetradecanoate) dichromium.

48. A method according to claim 38, wherein the active component(s) of the first chemical agent comprises pentahydroxy (tetradecanoate) dichromium derivative.

49. A method according to claim 38, wherein the active component(s) of the first chemical agent comprises silicon tetraacetate.

50. A method according to claim 38, wherein the active component(s) of the first chemical agent comprises dimethylolurea.

51. A method according to claim 38, wherein the active component(s) of the first chemical agent comprises methyloldimethylhydantoin.

52. A method according to claim 38, wherein the active component(s) of the first chemical agent comprises 1,3,5-triacryloyl-hexahydro-s-triazine.

53. A method according to claim 1, wherein the active component(s) of the first chemical agent constitutes from 0.5 to 100 wt. % of the first chemical agent.

54. A method according to claim 1, wherein the first chemical agent is applied dropwise to the receptor element.

55. A method according to claim 54, wherein the dropwise application is by an ink-jet printer having at least one ejection head.

56. A method according to claim 55, wherein the ink-jet printer has more than one ejection head.

57. A method according to claim 54, wherein the dropwise application is by an ink-jet plotter having at least one ejection head.

58. A method according to claim 57, wherein the ink-jet plotter has more than one ejection head.

59. A method according to claim 1, wherein the first chemical agent is supplied to the receptor element by a hand-held delivery device.

60. A method according to claim 1, wherein the stencil is further toughened by a post-treatment using further chemicals.

61. A method according to claim 60, wherein the further chemicals are resident in the image-receiving layer.

62. A method according to claim 60, wherein the further chemicals are resident in the stencil-forming agent.

63. A method according to claim 60, wherein the further chemicals are applied image-wise.

64. A method according to claim 60, wherein the further chemicals include an aqueous base.

65. A method according to claim 64, wherein the base is potassium carbonate.

66. A method according to claim 1, wherein the stencil is further toughened by a post-treatment using actinic radiation.

67. A method according to claim 1, wherein the stencil is further toughened by a post-treatment using heat.

68. A method according to claim 1, including a further, reclaim step.

69. A method according to claim 68, wherein the first chemical agent comprises a borate and the reclaim is carried out at a pH of 4 or less.

70. A method according to claim 1, wherein the second chemical agent is applied to the screen printing screen from one side thereof after the receptor element has been applied to the other side thereof with its image-receiving layer in contact with the screen, whereby the image-receiving layer is brought onto contact with the second chemical agent.

71. A method according to any of claim 1, wherein the second chemical agent is applied to the screen printing screen and the receptor element is subsequently brought into contact with the screen to bring the image-receiving layer thereof into contact with the second chemical agent.

72. A method according to claim 1, wherein any support base present is removed before washing away the second chemical agent in the higher solubility areas.

73. A method according to claim 1, wherein any support base present is removed by the washing away of the second chemical agent in the higher solubility areas.

74. A method of screen printing which comprises producing a screen-printing stencil having open areas and blocked areas for respectively passage and blocking of a printing medium, the method comprising:

providing a receptor element comprising an image-receiving layer capable of receiving a first chemical agent in areas corresponding to the blocked areas of the stencil to be produced;

applying the first chemical agent to the image-receiving layer of the receptor element in the said corresponding areas;

applying a second, stencil-forming chemical agent to a screen printing screen;

bringing the image-receiving layer of the receptor element into contact with the stencil-forming agent, to allow the first and second chemical agents to react to produce on the screen a stencil-forming layer having areas of lower solubility corresponding to the said blocked areas and areas of higher solubility in areas corresponding to the open stencil areas;

removing any remaining unreacted part of the receptor element;

washing away the second chemical agent in the higher solubility areas, thereby to produce the screen-printing stencil;

placing the screen-printing stencil in contact with a substrate; and passing a printing medium through the open areas of the stencil to produce printing on the substrate in areas corresponding to the open areas of the stencil.

* * * * *